US007303049B1

(12) United States Patent
Greenlee

(10) Patent No.: US 7,303,049 B1
(45) Date of Patent: Dec. 4, 2007

(54) SYSTEM FOR PEOPLE WITH LIMITED MOBILITY OR WITH ELEVATED RISK OF FALLING

(76) Inventor: Wilfred E. Greenlee, 4423 Eagles Cove Ct., Louisville, KY (US) 40241-4802

( * ) Notice: Subject to any disclaimer, the term of this patent is extended or adjusted under 35 U.S.C. 154(b) by 0 days.

(21) Appl. No.: 11/422,651

(22) Filed: Jun. 7, 2006

(51) Int. Cl.
*B66C 17/06* (2006.01)

(52) U.S. Cl. ..... 182/37; 182/3; 212/284; 482/69

(58) Field of Classification Search ..... 182/3, 182/36, 37; 5/89.1; 482/69; 212/284
See application file for complete search history.

(56) References Cited

U.S. PATENT DOCUMENTS 3,780,663 A * 12/1973 Pettit ..... 104/307
4,243,147 A * 1/1981 Twitchell et al. ..... 212/284
4,907,571 A * 3/1990 Futakami ..... 601/23
5,731,528 A * 3/1998 Yamazaki et al. ..... 73/862.41
6,315,138 B1 * 11/2001 Dyson ..... 212/336

* cited by examiner

*Primary Examiner*—Alvin Chin-Shue

(57) ABSTRACT

A system for people with limited mobility or with elevated risk of falling. Embodiments of the invention include internal walls that do not extend to the ceiling, a track system, a joist which is able to move on the track system, a carriage which is able to move on the joist and a harness tethered to the carriage. Other embodiments of the invention include a track system which is able to move on the track system, a carriage able to move on the joist and a harness, which is configured for an ambulatory user, tethered to the carriage. Some embodiments include a system that can automatically trigger an alert notification if the tension on the tether remains high beyond a particular time. In some embodiments, the joist is an open web joist.

1 Claim, 14 Drawing Sheets a b

SYSTEM FOR PEOPLE WITH LIMITED MOBILITY OR WITH ELEVATED RISK OF FALLING

CROSS-REFERENCE TO RELATED APPLICATIONS

Not applicable

STATEMENT REGARDING FEDERALLY SPONSORED RESEARCH OR DEVELOPMENT REFERENCE TO SEQUENCE LISTING, A TABLE, OR A COMPUTER PROGRAM LISTING COMPACT DISK APPENDIX

Not applicable

BACKGROUND OF THE INVENTION

For certain people, the risk of accidentally falling during routine activities can be great. Such falls can lead to death or non-fatal injuries. It could be argued that the fear and self imposed limitations on routine activities can be as problematic as the falls themselves. Injuries due to falls and the fear of falling both contribute to loss of independence for many people, especially elderly people. Although falls are by no means limited to the elderly, many elderly people do fall. Approximately 30% of people over 65 years old fall each year with approximately one fifth of those falls requiring medical attention and approximately one tenth of those falls resulting in at least one fractured bone (L D Gillespie, W J Gillespie, M C Robertson, S E Lamb, R G Cumming and B H Rowe; 2001; Interventions for preventing falls in elderly people; Cochrane Database of Systematic Reviews). In one study (J M Hausdorff, D A Rios and H K Edelberg; 2001; Gait variability and fall risk in community-living older adults: a 1-year prospective study; Archives of Physical Medicine and Rehabilitation; 82:1050-6) of community-living, ambulatory people who were at least 70 years old, 40% of the subjects experienced a fall in a one year period. Other conditions predispose individuals for a high risk of falling (for example, see Y Balash, C Peretz, G Leibovich, T Herman, J M Hausdorff and N Giladi; Falls in outpatients with Parkinson's disease: frequency, impact and identifying factors; 2005; Journal of Neurology; 252:1310-5). In another study (A Bergland, T B Wyller; 2004; Risk factors for serious fall related injury in elderly women living at home; Injury Prevention; 10:308-13) it was found that for community living women who were at least 75 years old; over half fell at least once in a one year period with 24% of those falls requiring medical attention and 13% of those falls resulting in at least one fractured bone. In institutional settings, the fall rates are even worse (L Z Rubenstein, K R Josephson, A S Robbins; 1994; Annals of Internal Medicine; Falls in the nursing home; 12:442-51).

Previous attempts have been made to increase safety for people at increased risk for falling. However, none has proven fully satisfactory for all situations.

A few of the interventions that seem to help reduce the risk of falls are muscle strengthening and balance retraining, Tai Chi group exercise, home hazard assessment and modification, and withdrawal of psychotropic medication (L D Gillespie, W J Gillespie, M C Robertson, S E Lamb, R G Cumming and B H Rowe; 2001; Interventions for preventing falls in elderly people; Cochrane Database of Systematic Reviews).

One object of some embodiments of the invention disclosed here is to increase the independence and confidence of people who would be at increased risk for falling.

Also, previous attempts have been made to increase safety and convenience of moving people with limited autonomous mobility. However, none has proven fully satisfactory for all situations. One object of some embodiments of the invention disclosed here is to increase safety and convenience of moving people with limited autonomous mobility.

BRIEF SUMMARY OF THE INVENTION

In brief, some embodiments of the invention disclosed here are buildings or portions of buildings equipped with a system that is intended to provide safety and confidence for people at increased risk of falling. In brief, the building, or a portion of the building is constructed so that the walls within that building or portion of the building do not extend all the way to the ceiling. The building or portion of the building is equipped with a track system that allows a carriage to follow the horizontal motion of the protected user. A protective device, such as a harness configured to be worn by and ambulatory user, is attached to the carriage.

Some embodiments of the invention disclosed here are systems that are intended to provide safety and confidence for people at increased risk of falling. In brief, system includes a track system that allows a carriage to follow the horizontal motion of the protected user. A protective device, such as a harness configured to be worn by and ambulatory user, is attached to the carriage.

Yet other embodiments of the invention disclosed here are buildings or portions of buildings equipped with a system that is intended to provide safety and convenience when moving people with limited autonomous mobility. In brief, the building, or a portion of the building is constructed so that the walls within that building or portion of the building do not extend all the way to the ceiling. The building or portion of the building is equipped with a track system that allows a carriage to follow the horizontal motion of the protected user. A protective device, such as a sling harness is attached to the carriage.

Certain other embodiments of the invention are described and depicted in this disclosure.

DETAILED DESCRIPTION OF THE INVENTION

The preferred embodiment of the invention disclosed here is described in more detail below. This embodiment is summarized as a building, or a portion of a building, with an interior floor plan which is essentially rectangular. The interior walls of that rectangular space do not extend all the way to the ceiling. On two walls which are essentially parallel to each other, a track is mounted below the ceiling and above the top of the interior walls. Between those tracks a movable-joist is disposed. A movable-carriage can travel along the movable-joist. Since the movable-joist can travel essentially the length of the room in a first dimension, and the movable-carriage can travel essentially the length of the room in a dimension which is perpendicular to the first dimension, the movable-carriage can be located in essentially any horizontal position in the rectangular space. In this preferred embodiment, the movable-carriage supports a lift system which, in turn, supports a harness which the user can wear. The system protects the user from accidental falls. As the user walks within the rectangular space, the movable-carriage follows the user overhead by a combination of the movable-carriage moving on the movable-joist and the movable-joist moving on the track. This is possible within a plurality of rooms because of the fact that the walls do not extend all of the way to the ceiling.

It should be noted that, in this disclosure, (including the claims) the term "interior walls" refers only to interior walls which are part of the permanent construction. This does not include readily movable partitions. Likewise, in this disclosure, (including the claims) the term "interior wall" refers only to an interior wall which is part of the permanent construction.

It should be noted that, in this disclosure, (including the claims) the term "joists" is used as a general term for any elongated, free-spanning, horizontal supporting members. Likewise, in this disclosure, (including the claims) the term "joist" is used as a general term for any elongated, free-spanning, horizontal supporting member.

Figure 1:
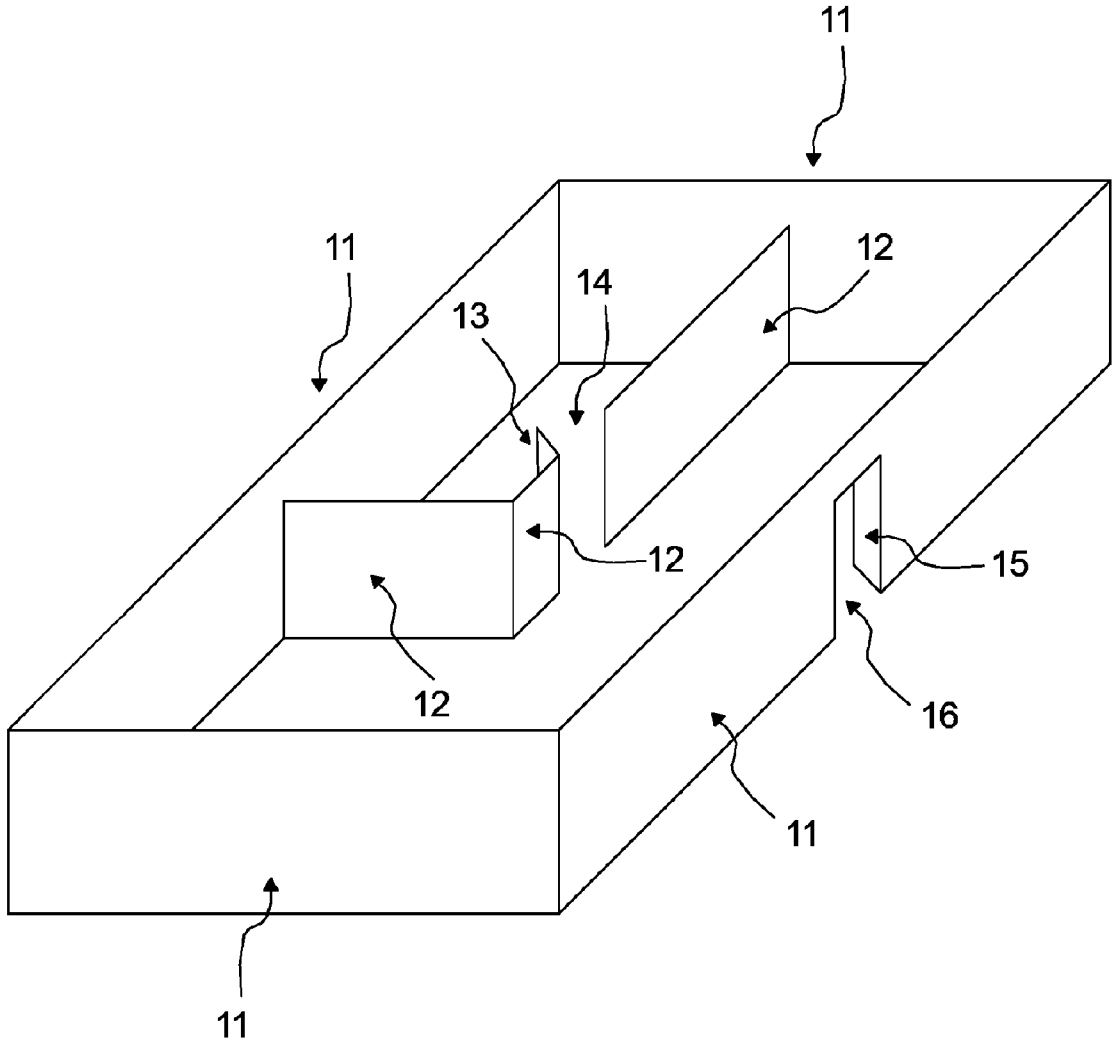
FIG. 1 depicts a simplified, idealized building or portion of a building which is an embodiment of the invention disclosed here. This isometric depiction shows walls and doors, but not other details.

FIG. 1 is an isometric depiction of a simplified, idealized building or portion of a building which is an embodiment of the invention disclosed here. The ceiling is not depicted. The exterior walls 11 of the building or portion of the building extend higher than the interior walls 12. The interior door 13 is essentially the same height as the interior walls. There is no top surround for the interior door opening. The exterior door 15 does not extend to the top of the exterior wall in which it is mounted. The door opening 16 does not extend to the top of the wall. It should be noted that the depiction here is highly simplified and is merely to show the general geometry of interior and exterior walls and doors. Possible floor plans are discussed below. It should be noted that construction would need to reinforce the interior walls since those walls would not be braced by attachment at their tops as is typical.

Figure 2:
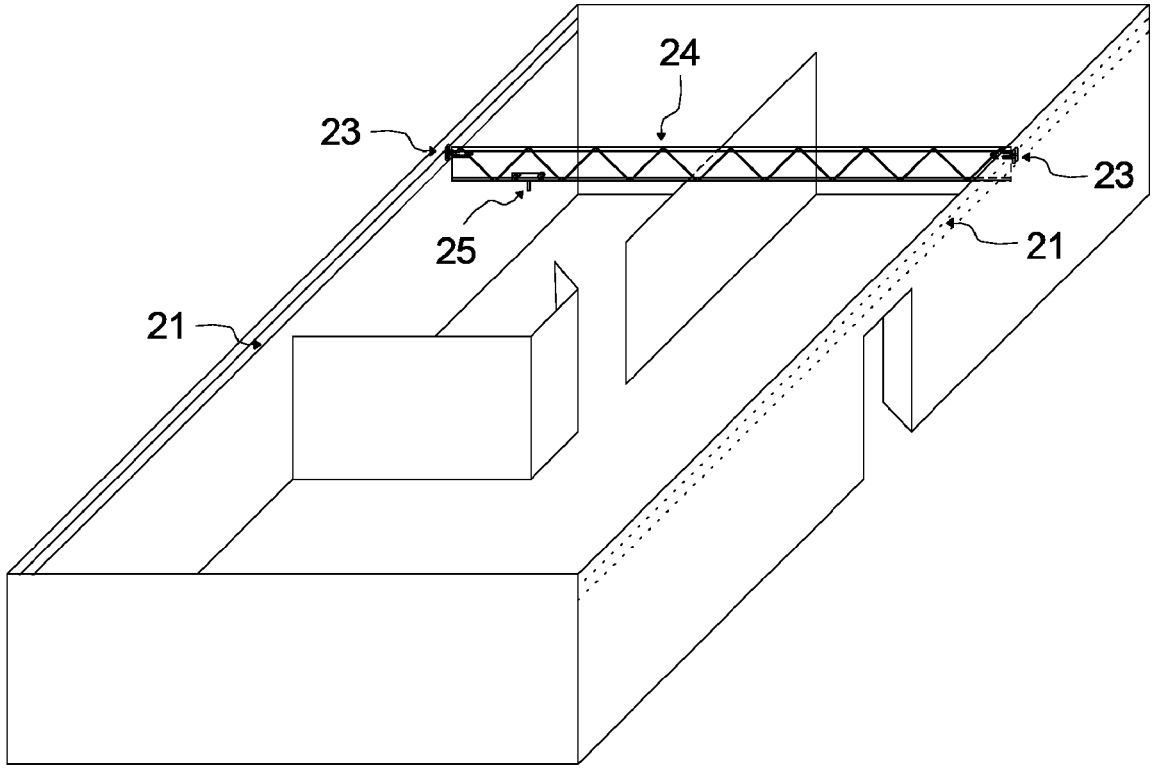
FIG. 2 depicts a simplified, idealized building or portion of a building which is an embodiment of the invention disclosed here. This isometric depiction shows walls and doors, and the general placement of the components of the track, movable-joist and roller system.

FIG. 2 depicts a simplified, idealized building or portion of a building which is an embodiment of the invention disclosed here. The depiction is similar to FIG. 1. For clarity, arrows and reference characters for parts identified in FIG. 1 are not included in FIG. 2. There is a track 21 mounted on each of two exterior walls. That track supports track-rollers 23 at each end of a movable-joist 24. That movable-joist supports a movable-carriage 25. Again, it should be noted that the depiction here is highly simplified and is merely to show the general geometry of the parts indicated. It should be noted that although the movable-joist and movable-carriage are shown in particular positions, they are, in fact, movable and could appear in other positions within the building or portion of a building. In the preferred installation of the preferred embodiment of the invention disclosed here, the movable-joist spans the shorter dimension of the rectangular space. This requires less material, results in a lighter movable-joist, and gives greater strength.

Figure 3:
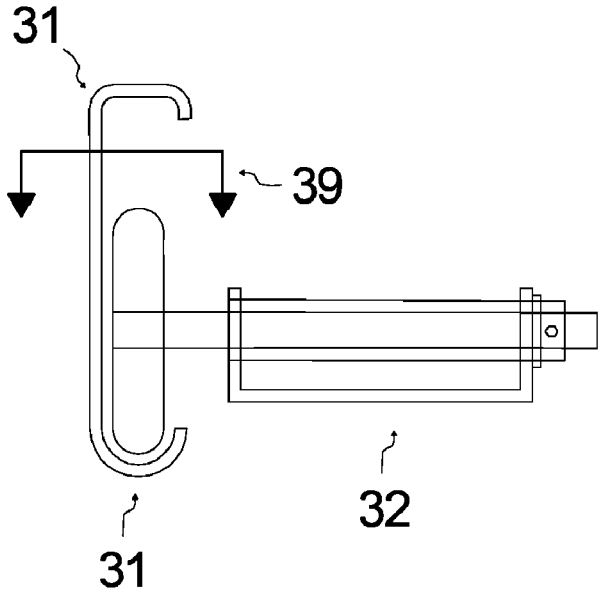
FIG. 3 depicts one of the wall mountable tracks of the preferred embodiment of the invention disclosed here. This figure includes two views of the track. View "a" shows the profile of the track and includes a track-roller-assembly to indicate the general positioning of the track-roller within the track. View "b" shows the end of the track including a stop to constrain the tracker-roller on the track.
Figure 3:
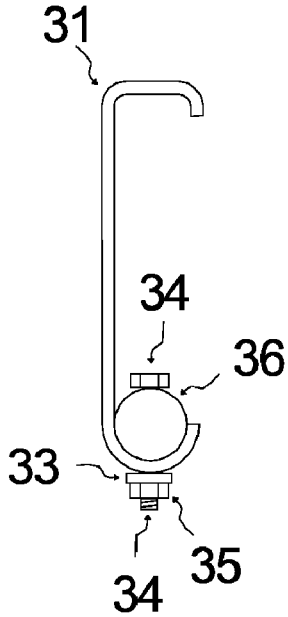

FIG. 3 depicts one of the wall mountable tracks of the preferred embodiment of the invention disclosed here. This figure included two views of the track. View "a" shows the profile 31 of the track and includes a track-roller-assembly 32 to indicate the general positioning of the track-roller within the track. Each end of each track of the preferred embodiment is equipped with a ball stop to constrain the tracker roller on the track. (The arrows and line 39 indicate the sectioning for FIG. 6.) View "b" shows an end of a track 31 including a ball stop 36. Each ball stop is attached to a track using a bolt 34, hex nut 35 and washer 33.

Figure 6:
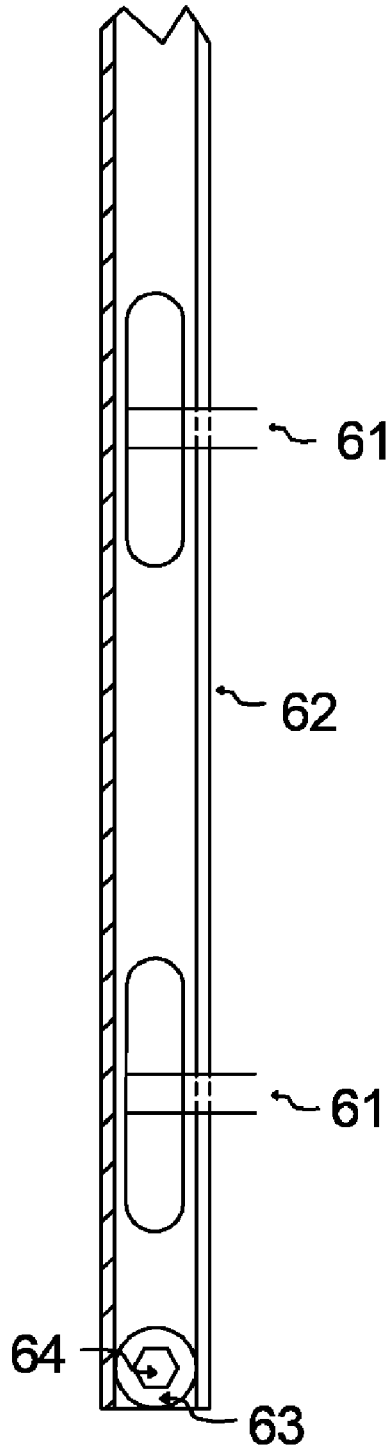
FIG. 6 depicts a region of one of the tracks of the preferred embodiment of the invention disclosed here. The depicted region includes one of the ends of the track. The point of view of the depiction is from above. The depiction includes two track-rollers.

FIG. 6 is a cross sectional depiction of a region of one of the tracks of the preferred embodiment of the invention disclosed here. (The specific cross sectioning was indicated on FIG. 3.) The depicted region includes one of the ends of the track, which is equipped with a ball stop 63 which is attached by a bolt 64. The point of view of the depiction is from above. The depiction includes two track-rollers 61. The specific position indicated for the rollers along the length of the track is arbitrary, since the rollers can move.

Figure 9:
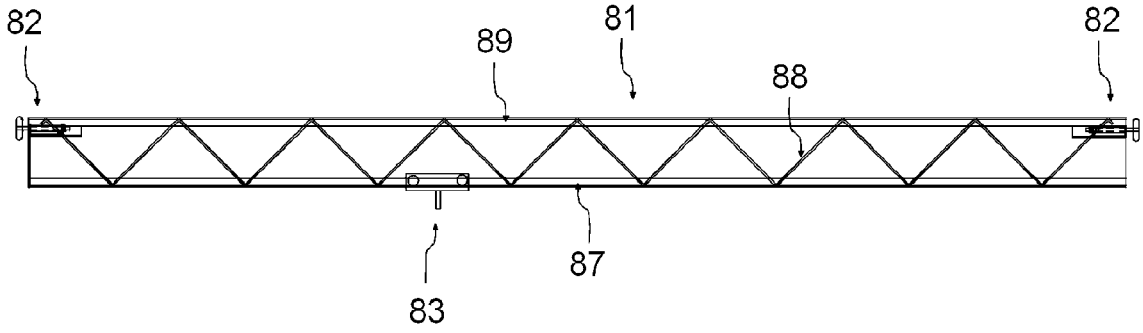
FIG. 9 is a side depiction of the full length of the movable-joist of the preferred embodiment of the invention disclosed here. The depiction also includes the track-roller-assemblies and the movable-carriage.

FIG. 9 is a side depiction of the full length of the movable-joist 81 of the preferred embodiment of the invention disclosed here. The depiction also includes the track-roller-assemblies 82 and the movable-carriage 83. It should be noted that the movable-carriage could be elsewhere along the length of the movable-joist and is shown in an arbitrary location. The track-rollers are mounted in track-roller assemblies (described in more detail below). Those track-rollers support the movable-joist. The movable-joist includes a top cord 89, a bottom cord 87 and a movable-joist web 88. Although other movable-joist configurations could be used in embodiments of the invention disclosed here, the open web joist configuration of the preferred embodiment is favored because it is strong enough for the purpose and yet is reasonably light weight. The open web design also makes efficient use of materials. If the movable-joist is constructed using 0.25 inch thick steel cords and 0.25 inch thick steel web and the movable-joist spans 4 meters, it is estimated that the harness could safely handle an approximately 180 kg static load yet is estimated to weight only approximately 40 kg.

Figure 8:
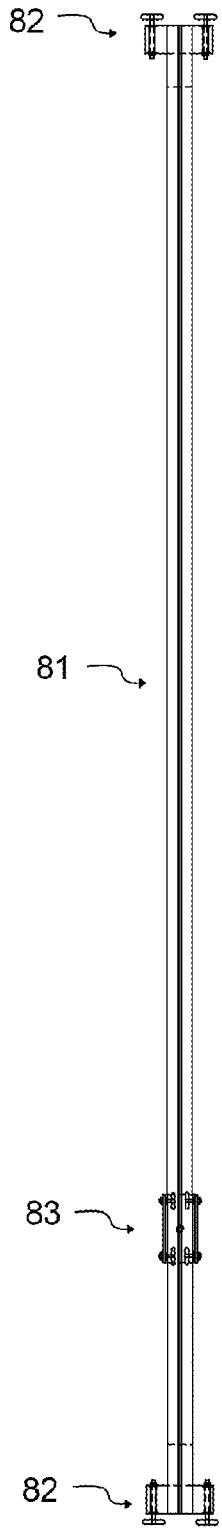
FIG. 8 depicts the full length of the movable-joist of the preferred embodiment of the invention disclosed here. The depiction also includes the track-roller-assemblies and the movable-carriage. The point of view of the depiction is from above.

FIG. 8 depicts the full length of the movable-joist of the preferred embodiment of the invention disclosed here. The depiction also includes the track-roller-assemblies and the movable-carriage. The point of view of the depiction is from above, which is orthogonal to the point of view of FIG. 9. The track-roller-assemblies 82 are at the ends of the movable-joist 81. The movable-carriage 83 is shown in an arbitrary position along the movable-joist.

Figure 11:
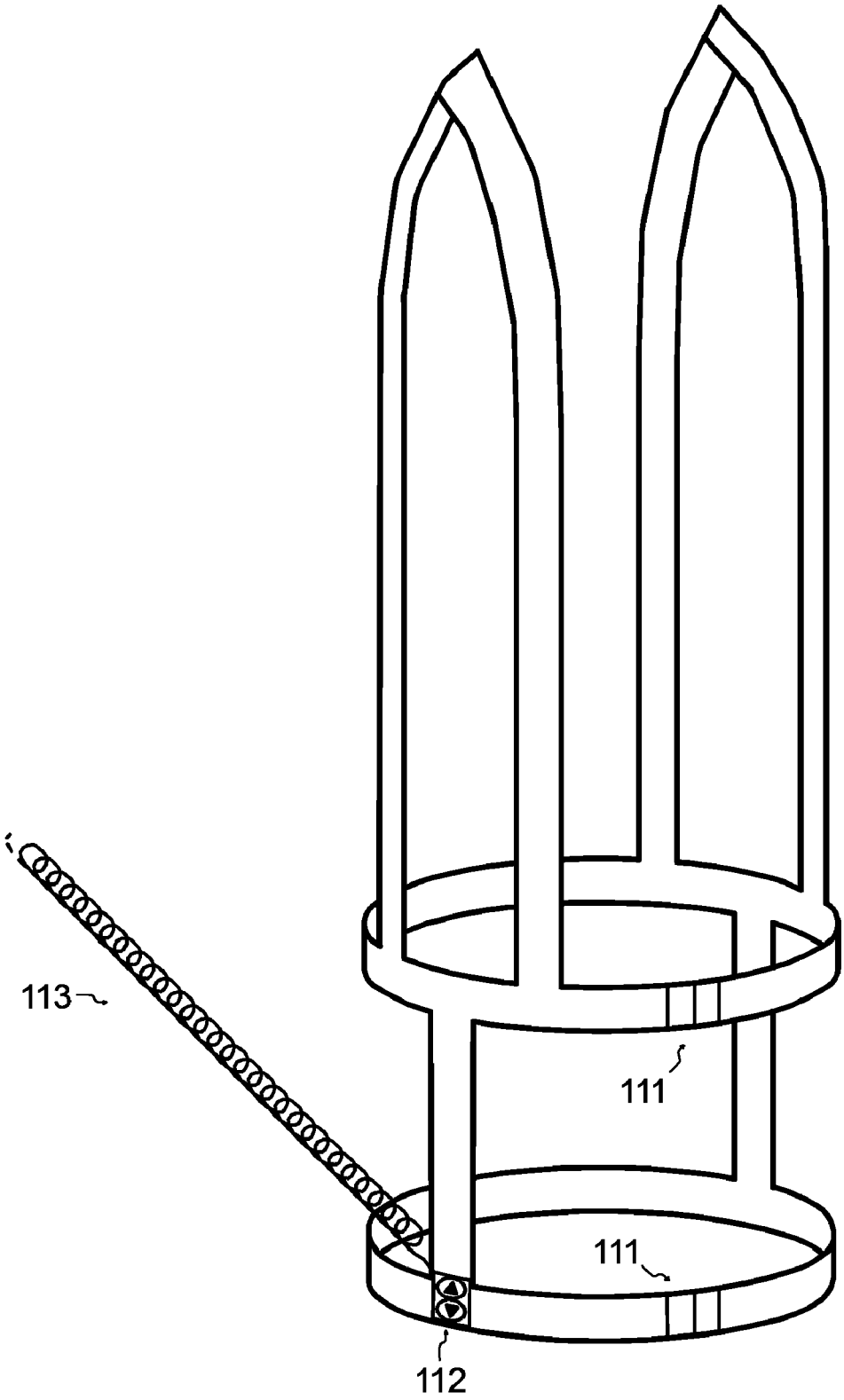
FIG. 11 depicts the harness of the preferred embodiment of the invention disclosed here.

FIG. 11 depicts the harness of the preferred embodiment of the invention disclosed here. The portion of the harness intended to be fitted under the arms of the user and the portion of the harness intended to be fitted around the waist of the user are equipped with a quick disconnect 111. Although other types of disconnects could be used, parachute buckles would be used in the preferred embodiment. The harness includes controls 112 which can be used to cause the lift system to raise or lower the harness. Wires in a conventional spiral cord 113 allow communication between the controls and the lift system. In FIG. 11, only a portion of the spiral cord is depicted. The harness is flexible and can have various conformations. The conformation shown is somewhat different from the typical conformation of the harness when in use. The conformation depicted was selected to allow a clear view of the harness. The preferred principle material for the harness is woven nylon straps.

Figure 10:
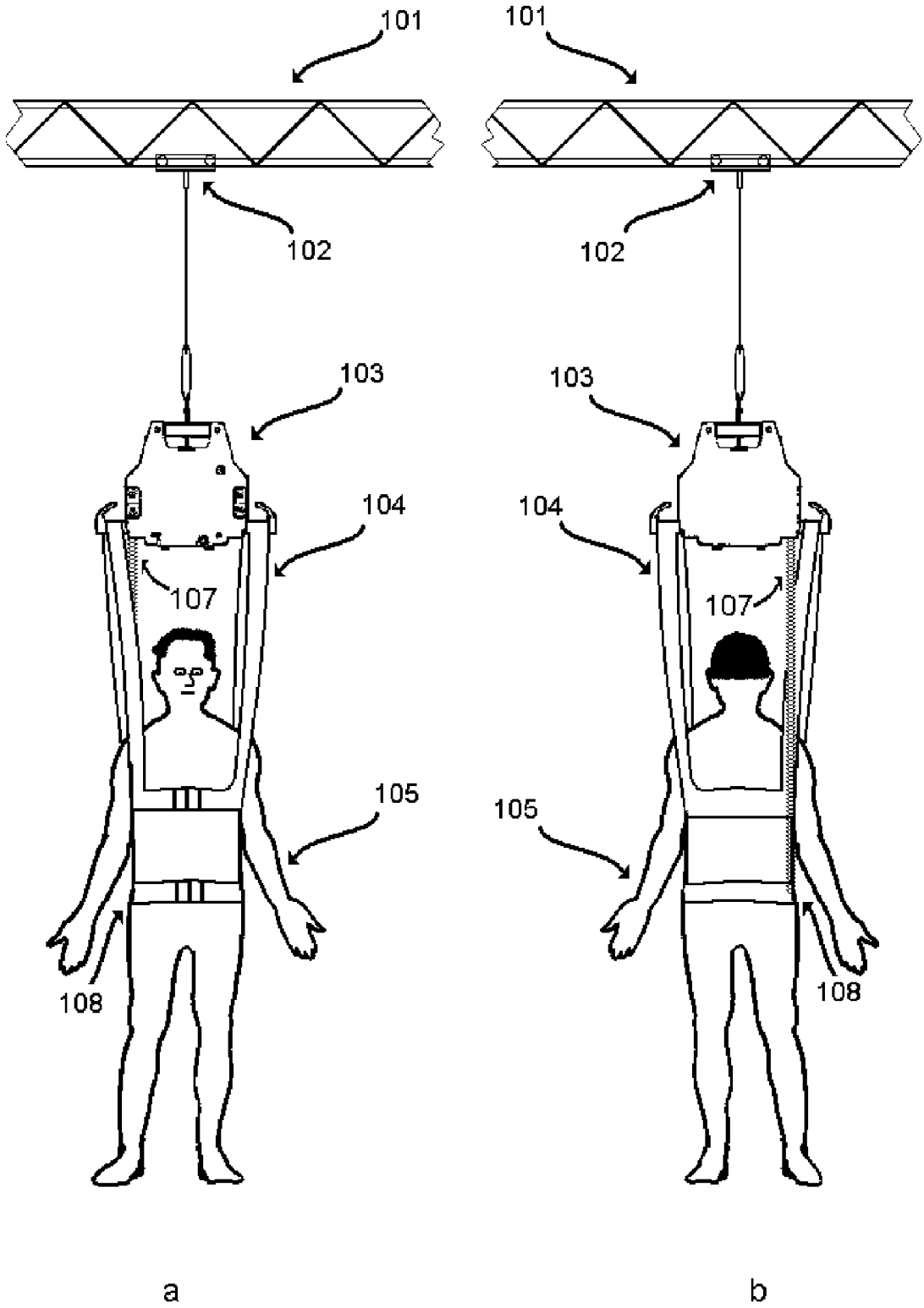
FIG. 10 depicts a portion of the movable-joist of the preferred embodiment of the invention disclosed here. Also depicted is the movable-carriage born by the movable-joist, the lift system tethered to the movable carriage, the harness supported by the lift system and the user wearing the harness. The figure includes two views which are from opposite view points.

FIG. 10 depicts a portion of the movable-joist 101 of the preferred embodiment of the invention disclosed here. That section bears the movable-carriage 102. The movable-carriage is connected to a lift system 103 using a tether. That lift system supports that harness 104 worn by a user 105. The harness includes controls which can be used to cause the lift system to raise or lower the harness. The controls themselves are not depicted in this figure. However, the approximate location 108 on those controls is indicated in this figure. Wires in a conventional spiral cord 107 allow communication between the controls and the lift system. The figure includes two views which are from opposite view points. View "a" looks towards the front of the user; View "b" looks towards the back of the user.

Each of the rollers (track-rollers and movable-carriage-rollers) in the preferred embodiment of the invention disclosed here is packed with ball bearings about the axle with which that roller is associated. The roller surface of the preferred embodiment is nylon.

Although other materials could be used, all parts of the movable-joist, movable-carriage, and track-roller-assemblies of the preferred embodiment of the invention disclosed here are steel, except as otherwise specified in this disclosure.

Figure 4:
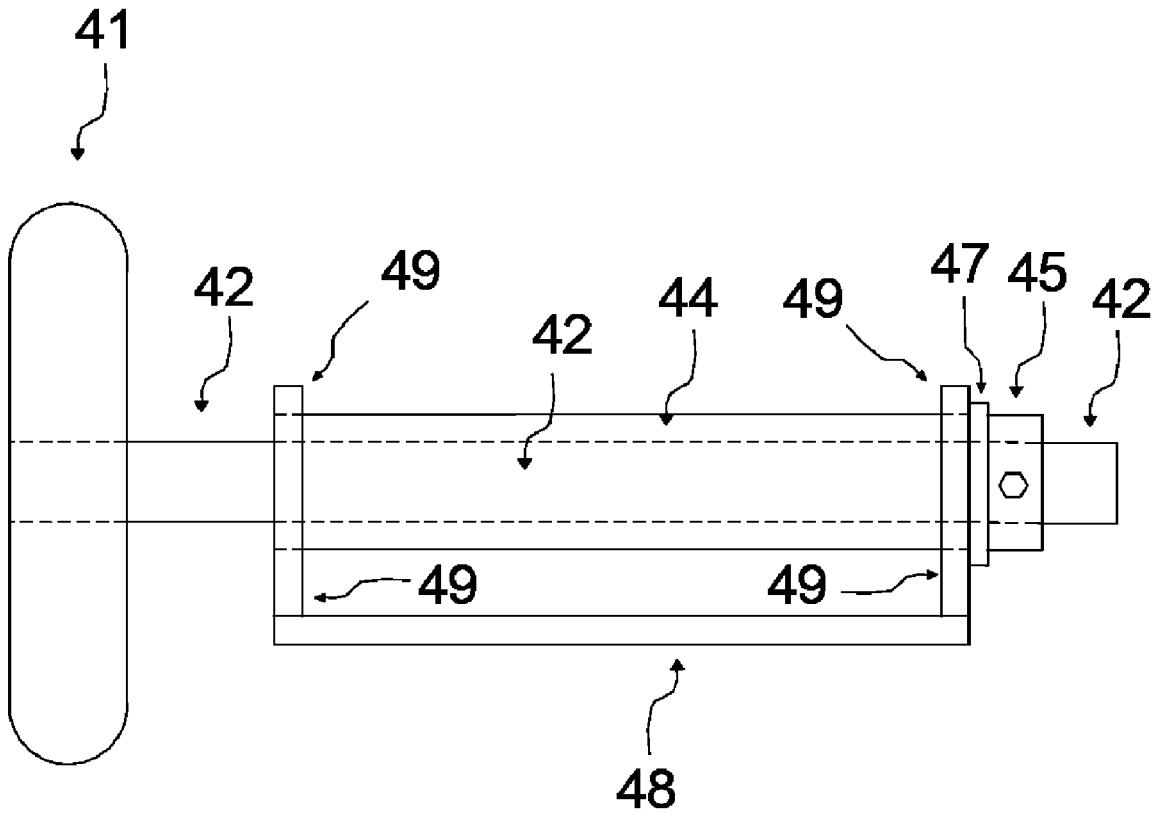
FIG. 4 depicts one of the track-roller-assemblies of the preferred embodiment of the invention disclosed here.

FIG. 4 depicts one of the track-roller-assemblies of the preferred embodiment of the invention disclosed here. Each track-roller-assembly has two rollers. In this figure, only one track-roller is depicted because the other track-roller is eclipsed. An axle 42 is embedded within the track-roller 41. The majority of the axle is sheathed by an axle sleeve 44. The axle is constrained by a set collar 45 which is faced by a flat washer 47. The axle sleeve is welded to the lobes 49 which are welded to the bearing plate 48.

Figure 12:
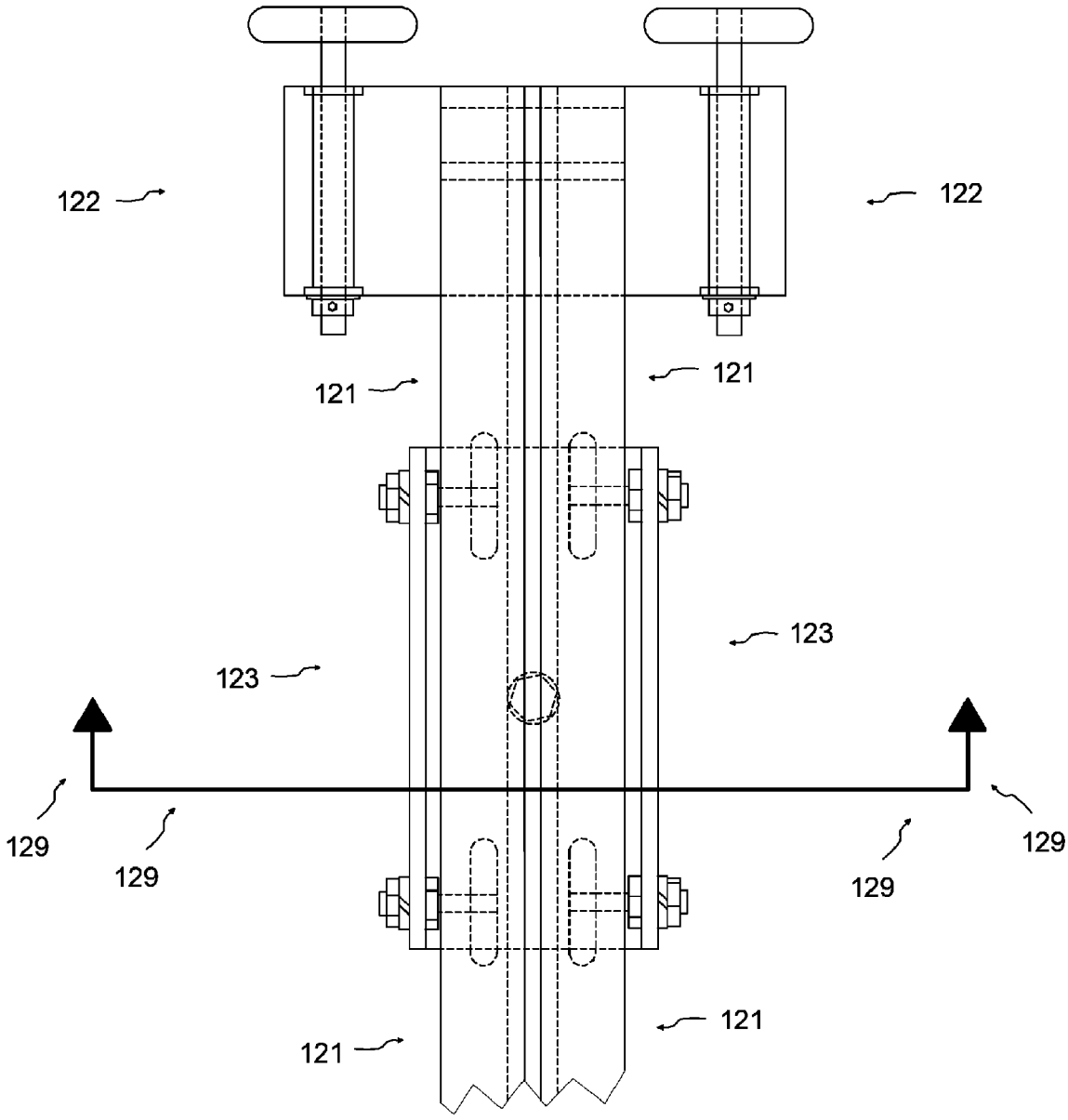
FIG. 12 is a similar depiction to FIG. 5. Lines and arrows indicate the sectioning for FIG. 7.

FIG. 12 depicts a region including one end of a movable-joist 121 of the preferred embodiment of the invention disclosed here. The depiction also includes a track-roller-assembly 122 and the movable-carriage 123. The point of view of the depiction is from above. Lines and arrows 129 indicate the sectioning for FIG. 7.

Figure 7:
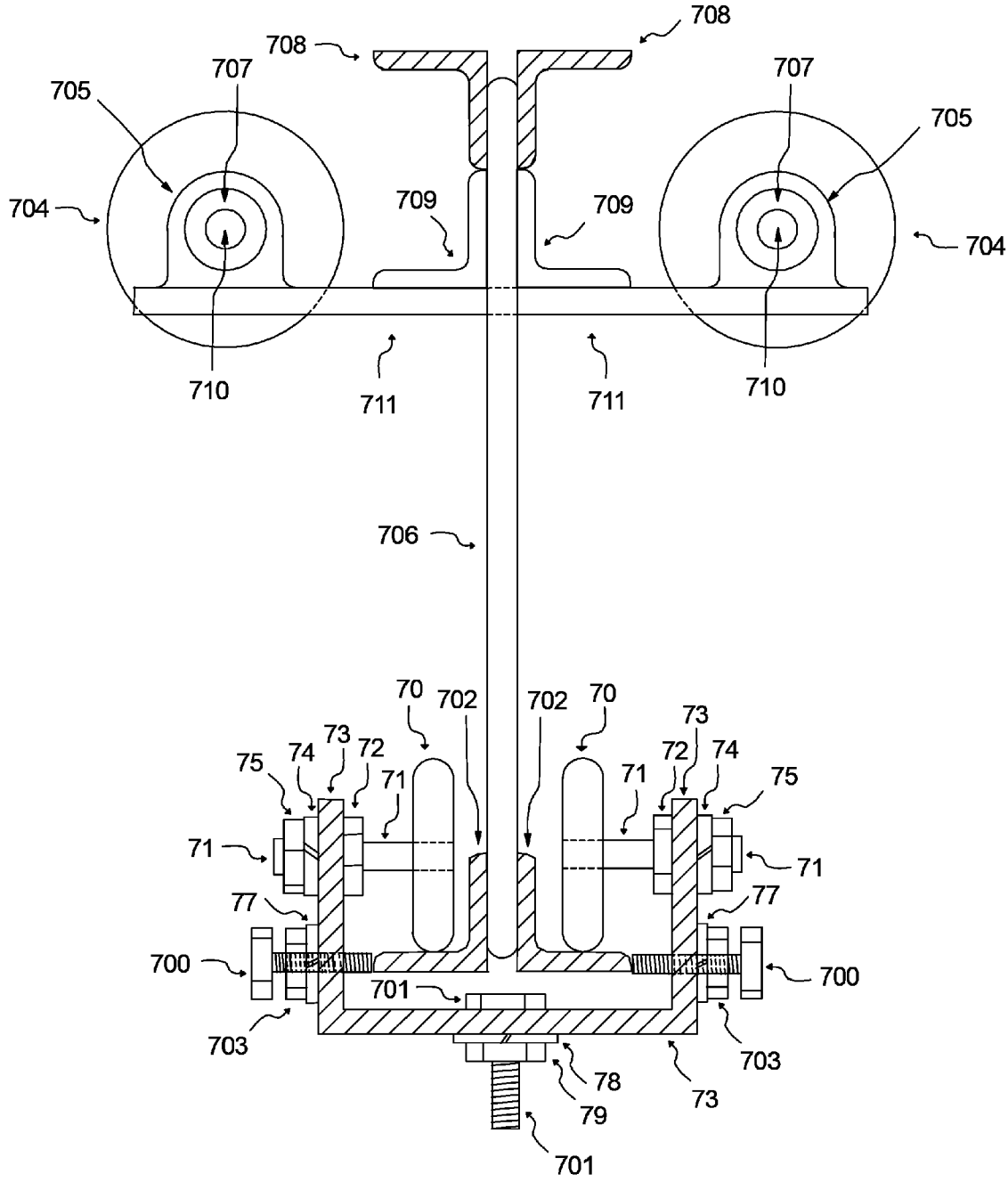
FIG. 7 is a side depiction of the movable-joist of the preferred embodiment of the invention disclosed here. The depiction also includes one of the track-roller-assemblies and the movable-carriage.

FIG. 7 is a depiction which includes the movable-joist of the preferred embodiment of the invention disclosed here. The sectioning for FIG. 7 is indicated in FIG. 12. The movable-joist web 706 is welded to the two top cords 708 and two bottom cords 702. That movable-joist web and the cords run almost the entire length of the movable-joist. At each end of the movable-joist, there are two bearing cords 709 with essentially the same profile shape as the cords. Each bearing cord is welded to the movable-joist web, to the top cord on its own side of the movable-joist web and to a bearing plate 711. Four lobes 705 are welded to the bearing plate (in the figure, two of the lobes are eclipsed by the other two). Axle sleeves 707 are disposed between pairs of lobes and are welded to the lobes. An axle 710 which is attached to a track-roller 704 is fixed in each sleeve. The set collar and facing washer (which are depicted in FIG. 4) are not depicted in this figure for the sake of clarity. The movable-carriage includes four carriage-rollers 70. In this figure, two carriage-rollers are eclipsed by the two carriage-rollers that are depicted. An axle 71 is embedded in each of the carriage-rollers. It should be noted that the end of each carriage-roller axle that is further from the roller is threaded. Each carriage-roller is free to rotate on its axle. Each axle is attached to the carriage-body by means of a hex nut 72 on the inside of the carriage body, a lock washer 74 and a hex nut on the outside of the carriage body. Vertically aligned with each axle, a nylon bolt 700 is attached to the carriage-body using a jam hex nut 703 and a lock washer 77. At the bottom of the movable-carriage, hardware for attaching the harness includes a bolt 701, a lock washer 78, and a hex nut 79.

Figure 5:
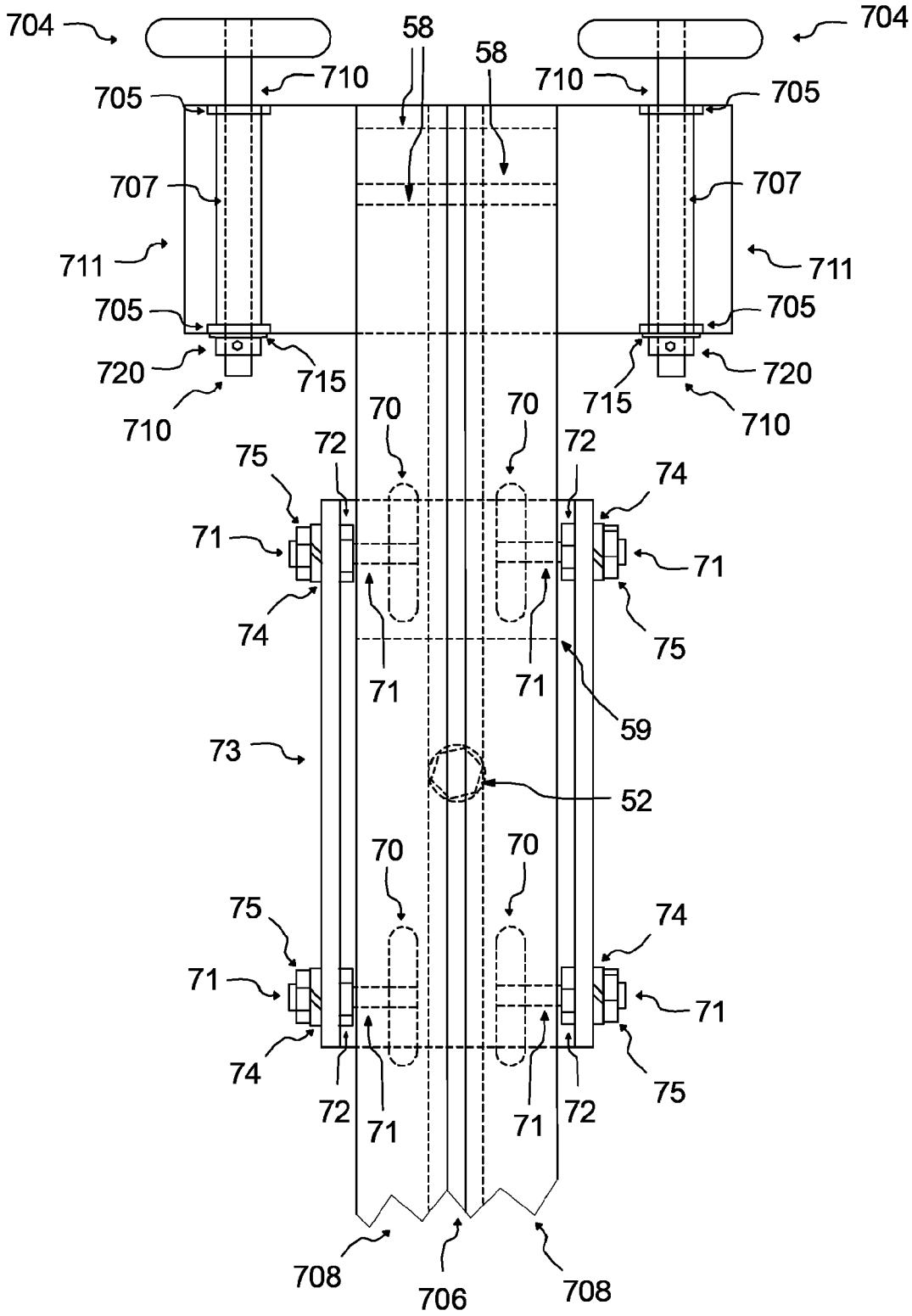
FIG. 5 depicts a region including one end of a movable-joist of the preferred embodiment of the invention disclosed here. The depiction also includes one of the track-roller-assemblies and the movable-carriage. The point of view of the depiction is from above.

FIG. 5 depicts a region including one end of a movable-joist of the preferred embodiment of the invention disclosed here. The depiction also includes one of the track-roller-assemblies and the movable-carriage. The point of view of the depiction is from above. The movable-joist web 706 is welded to the two top cords 708. The two bottom cords are eclipsed in this figure. That movable-joist web and the cords run almost the entire length of the movable-joist. Four lobes 705 are welded to the bearing plate 711, four lobes 705. Axle sleeves 707 are disposed between pairs of lobes and are welded to the lobes. An axle 710 which is attached to a track-roller 704 is fixed in each axle sleeve. The set collar 720 is faced with a flat washer 715 and used to secure the axle in the sleeve. The movable-carriage includes four carriage-rollers 70. An axle 71 is embedded in each of the carriage-rollers. Each carriage-roller is free to rotate on its axle. Each axle is attached to the carriage-body by means of a hex nut 72 on the inside of the carriage body, a lock washer 74 and a hex nut 75 on the outside of the carriage body. For clarity, the nylon bolts and associated hardware are not shown on this figure. Hardware 52 for attaching the harness is included at the bottom of the carriage-body. FIG. 5 includes hidden lines for the bend plate 58 and bearing cord 59. Those parts are described below. The bend plate is depicted more clearly in FIG. 13. The bearing cord is depicted more clearly in FIGS. 7 and 13.

Figure 13:
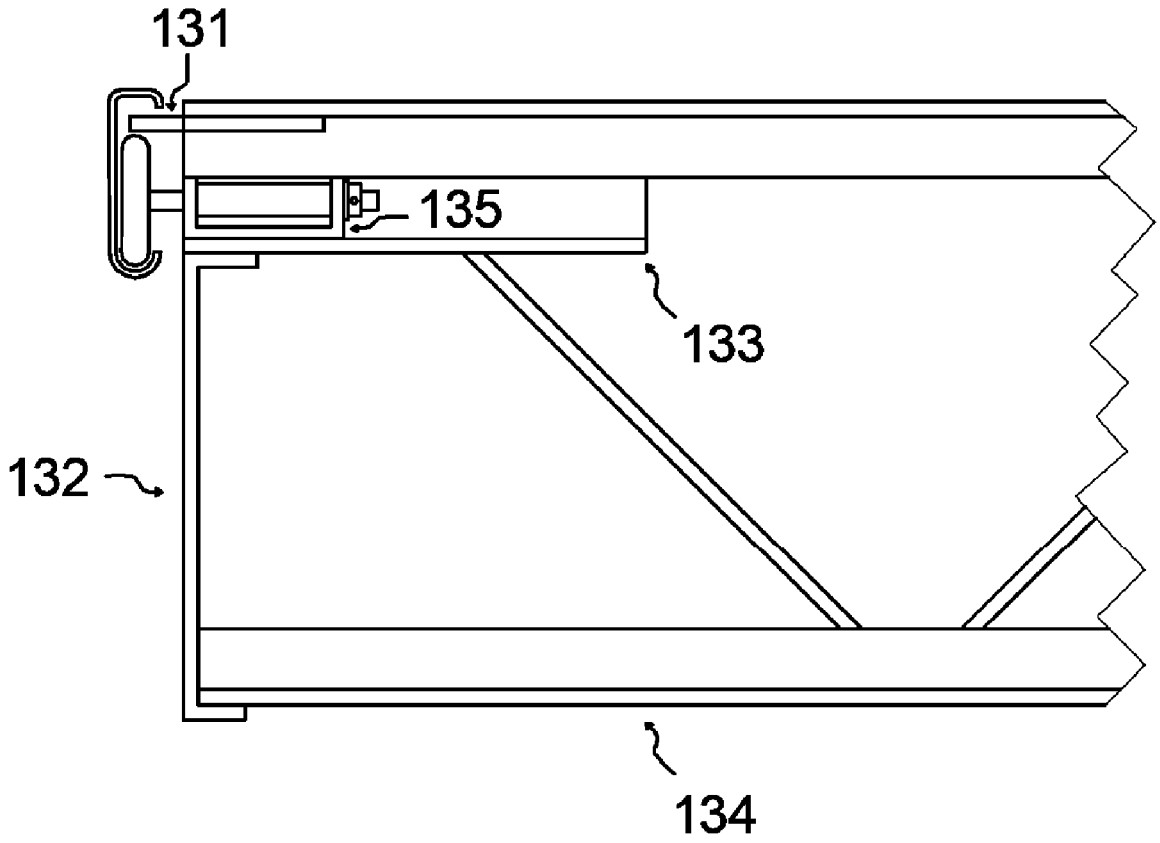
FIG. 13 is a side depiction of the end of the movable-joist of the preferred embodiment of the invention disclosed here. It shows how the track-roller-assembly and end of the movable-joist are configured.

FIG. 13 is a side depiction of one end of the movable-joist of the preferred embodiment of the invention disclosed here. It shows how the track-roller-assembly and end of the movable-joist are configured. The configuration is essentially the same at each end of the movable-joist. At each end of the movable-joist, a safety guard 131 is welded to each top cord. The bearing plate 135 of the track-roller-assembly is welded to the bearing cord 133. A bent plate 132 is welded to the bottom of the bearing cord 133 and the bottom of the bottom cord 134.

The lift system of the preferred embodiment is the Guardian Voyager Portable Overhead Lifter marketed by Sunrise Medical, Carlsbad, Calif. This lift system is battery powered. Inclusion of the lift system in this preferred embodiment allows the user to raise and lower the hoist to allow for transitions, for example, from sitting to standing or from standing to sitting. Typically, the harness height would be such that there is approximately 8 cm of slack. That would allow for user comfort, but would allow the harness to promptly arrest an accidental fall by the user.

The preferred embodiment of the invention disclosed here could include buildings or portions of buildings with a variety of specific floor plans.

It is envisioned that, in many cases, in areas which are preferred embodiments of the invention disclosed here, the ceilings would be at least 3 meters above the floor.

There are embodiments of the invention disclosed here that are similar to the preferred embodiment, except that the area includes a plurality of rectangular regions which can not be accessed with a single system such as found in the preferred embodiment. One example is that in a retrofit structure separate systems could allow protected access to a main room and a different system could allow protected access to a bathroom. In another example, a living area similar to the preferred embodiment could be connected to an attached garage in which the user would be protected by a separate system. The tether between the lift system and the harness could be equipped with a quick disconnect of one of the types well known in the art. This would allow the user to disconnect from one system and connect to another. It is preferred that a seat be available near the location where the user would disconnect from one system and connect to another so that the user can be sitting when the change occurs.

There are embodiments of the invention disclosed here that are similar to the preferred embodiment except that the embodiment lacks interior walls.

There are embodiments of the invention disclosed here that are similar to the preferred embodiment except that a track system is mounted to the ceiling instead of to walls.

Figure 14:
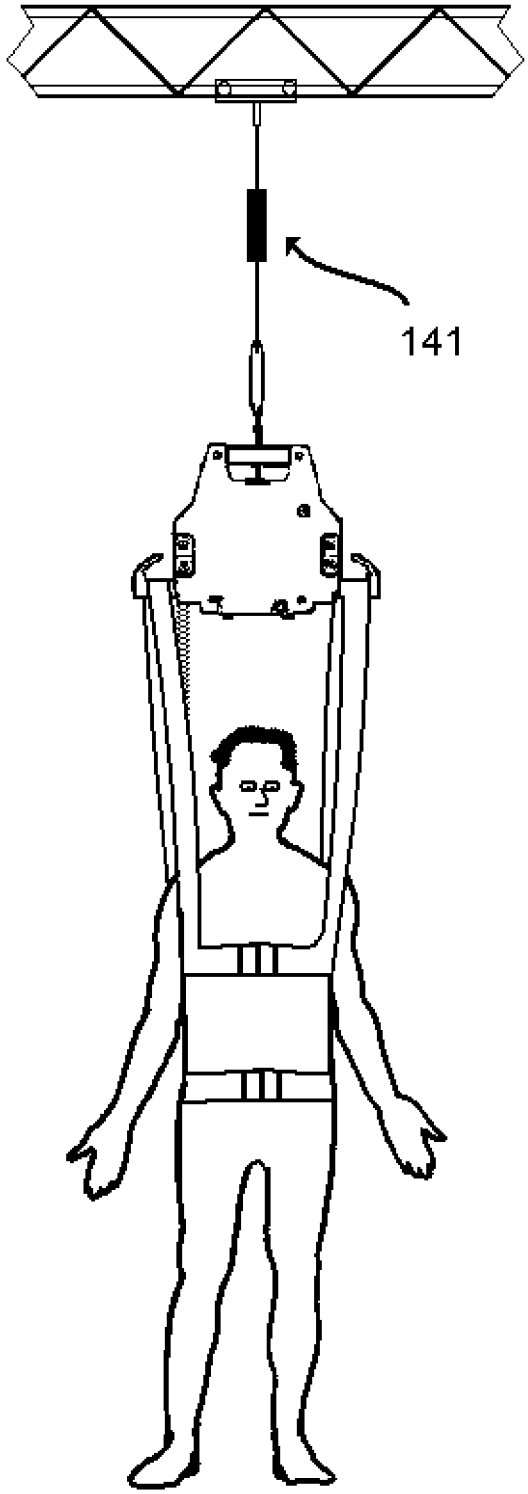
FIG. 14 depicts an alternative embodiment of the invention disclosed here which is similar to the preferred embodiment except that the tether between the lift system and the harness is equipped with a tension detection device.

There are embodiments of the invention disclosed here that are similar to the preferred embodiment, except that the tether between the lift system and the harness is to be equipped with a tension detection device. One purpose of such a feature is to allow notification of others when the user is in distress of a sort that makes it impossible for the user to actively summons help. One such embodiment is depicted in FIG. 14. When a predetermined amount of tension exists on the tether for a predetermined length of time, the battery powered detector 141 sends a radio signal to a receiving unit. Depending on the specific receiving unit and the system of which it is a part, some alert occurs to allow others to know that the user may be in distress. This alert may include automatic dialing of pre-designated phone number and delivery of a prerecorded message. This alert may also include sounding of an alarm. This system could include a pre-alarm signal to make the user aware that tension is on the tether and will soon trigger the alert system. That pre-alarm could be locally activated by the detector, or could be triggered by a radio signal sent by the detector.

It is envisioned that embodiments of the invention disclosed here could be used with people undergoing rehabilitation for health problems, including those caused by injuries.

The preferred embodiment of the invention disclosed here includes a harness configured for an ambulatory user. However, there are embodiments of the invention disclosed here which are essentially the same as the preferred embodiment except that they are equipped with a sling harness instead of the sort of harness used in the preferred embodiment. This would be appropriate for a user who is not ambulatory. A care-giver could use such an embodiment to move the user within the protected area. It should be noted that in cases in which an ambulatory user becomes non-ambulatory, the harness configured for an ambulatory user could be replaced by a sling harness.

It is specifically envisioned that individual homes could be constructed or retrofitted to be embodiments of the invention disclosed here. It is also specifically envisioned that apartment buildings could be constructed or retrofitted to allow some or all of the apartments to be embodiments of the invention disclosed here. It is also specifically envisioned that all or part of certain institutional structures could be embodiments of the invention disclosed here. It is also envisioned that other sorts of buildings, or parts of buildings, not specifically mentioned could be embodiments of the invention disclosed here.

Embodiments of the invention disclosed here would almost certainly be considerably more expensive to construct than similar buildings not equipped with the fall protection system disclosed here. However, in cases in which the invention allows the user to live independently when they otherwise could not, the invention would, in many cases, result in significant financial savings. Likewise, the savings in medical costs by preventing a fall could result in significant financial savings. In addition, the ability to live independently could have a major, albeit hard to quantify, positive impact on the user's quality of life.

It would be possible for embodiments of the invention disclosed here to be adapted by way of modifying the harness for non-human users. This could include, but is not limited to, companion animals which are handicapped and animals which are undergoing veterinary care.

From the above description and drawings, it will be understood by those of ordinary skill in the art that the particular embodiments shown and described are for purpose of illustration only, and are not intended to limit the scope of the invention. Those of ordinary skill in the art will recognize that the invention may be embodied in other specific forms without departing from its spirit or essential characteristics. References to details of particular embodiments are not intended to limit the scope of the claims.

No claim element herein is to be construed under the provisions of 35 U.S.C. § 112, sixth paragraph, unless the element is expressly recited using the phrase "means for" or "step for."

The invention claimed is:

1. A fall protection area comprising, external walls, a ceiling attached to said external walls, internal walls that do not extend to the ceiling, a track system comprising a pair of spaced tracks mounted on opposed said external walls, an open web joist extending between said opposed external walls and movably supported on said tracks, a carriage supported by, and able to move along the length of said joist, a tether having one end attached to the carriage and an opposite end connected to and suspending a lift system form the carriage, said lift system comprising a battery powered lift having hook means extending outwardly from both sides of the lift at a lower portion thereof, a harness comprising a waist strap, a chest area strap connected to said waist strap and a pair of elongated loop straps connected to and extending upwardly from said chest area strap to extend upwardly beyond the head of a user, wherein said loops are attached on opposite sides of said lift on said hook means and suspending the harness on the lift, a control cord having one end connected to said lift and having a controller connected to another end of the cord, said controller attached to said waist strap to control said lift to allow adjustment of the distance between the harness and the carriage, the tether having a battery powered tension detector attached thereto, a notification system that includes a receiving unit and a pre-alarm signal, when a predetermined tension exists on the tether said detector send a radio signal to said receiving unit to alert that a user is in distress, said alert includes automatic dialing of pre-designated phone numbers, delivery of a prerecorded messages and an alarm, said radio signal also triggers said pre-alarm signal.

* * * * *